US009650748B2

(12) United States Patent
Peterson

(10) Patent No.: US 9,650,748 B2
(45) Date of Patent: May 16, 2017

(54) SOUND ATTENUATING STRUCTURE

(71) Applicant: H. Fredrick Peterson, Bellevue, WA (US)

(72) Inventor: H. Fredrick Peterson, Bellevue, WA (US)

( * ) Notice: Subject to any disclaimer, the term of this patent is extended or adjusted under 35 U.S.C. 154(b) by 0 days.

(21) Appl. No.: 14/601,681

(22) Filed: Jan. 21, 2015

(65) Prior Publication Data

US 2015/0204034 A1 Jul. 23, 2015

Related U.S. Application Data

(60) Provisional application No. 61/929,695, filed on Jan. 21, 2014.

(51) Int. Cl.
*E01F 8/02* (2006.01)
*E01F 8/00* (2006.01)

(52) U.S. Cl.
CPC ..... *E01F 8/024* (2013.01)

(58) Field of Classification Search
CPC ... E01F 8/024; E01F 8/023; E01F 8/02; E01F 8/00; E01F 8/0023
USPC ..... 181/210, 285
See application file for complete search history.

(56) References Cited

U.S. PATENT DOCUMENTS 2,121,173 A * 6/1938 MacPherson ..... E01F 8/023 256/20
3,630,310 A 12/1971 Federer
4,084,367 A 4/1978 Saylor et al.
4,384,810 A * 5/1983 Neumann ..... E02D 29/0216 405/273
4,433,944 A 2/1984 Pilca et al.
4,437,542 A 3/1984 Yeager et al.
4,605,090 A 8/1986 Melfi
4,664,358 A * 5/1987 Clark ..... E01F 8/024 256/19
4,665,647 A 5/1987 Behrens et al.
4,785,577 A * 11/1988 Lederbauer ..... E01F 8/023 256/13.1

(Continued)

FOREIGN PATENT DOCUMENTS

AT EP 0388399 A2 * 9/1990 ..... E01F 8/024
CH 589757 A5 * 7/1977 ..... E01F 8/024

(Continued)

*Primary Examiner* — Edgardo San Martin
(74) *Attorney, Agent, or Firm* — AEON Law; Adam L. K. Philipp; Jonathan E. Olson

(57) ABSTRACT

A free standing vegetated sound attenuating structure is formed by placing multiple layers of rows of concrete stretchers on a level surface with concrete headers extending transversely thereto to form a rectilinear structure with substantially vertical sides, in which soil can be placed within the void formed by the headers and stretchers. The vegetated sound attenuating structure is positioned in a vertical array upwardly from the level surface so that both sides of the vegetated sound attenuating structure are visible. Exposed areas of soil visible between successive layers of concrete stretchers have suitable sound attenuating vegetation growing therefrom. Irrigation means, which may be powered by solar panels, provides moisture for the growing of the sound attenuating vegetation. Seed containing tiles, panels or fabric may be used in contact with the soil to promote growth of vegetation.

14 Claims, 4 Drawing Sheets

(56) References Cited

U.S. PATENT DOCUMENTS

| | | | | |
|---|---|---|---|---|
| 4,838,524 | A | 6/1989 | McKeown et al. | |
| 5,108,231 | A * | 4/1992 | Rausch | E02D 29/025 405/284 |
| 5,136,821 | A | 8/1992 | Child | |
| 5,199,215 | A * | 4/1993 | Lopez | E01F 8/02 47/1.01 R |
| 5,484,234 | A | 1/1996 | Worden | |
| 5,836,129 | A | 11/1998 | Jaecklin | |
| 7,814,703 | B2 | 10/2010 | Irwin | |
| 7,857,552 | B2 * | 12/2010 | Li | E01F 8/023 405/284 |
| 7,913,812 | B2 | 3/2011 | Sanders | |
| 2012/0083929 | A1 | 4/2012 | Conrad, Jr. | |
| 2012/0317922 | A1 | 12/2012 | Chang | |

FOREIGN PATENT DOCUMENTS

| | | | | |
|---|---|---|---|---|
| CH | EP 452744 | A1 * | 4/1991 | E01F 8/00 |
| DE | 2714524 | A1 * | 10/1978 | E01F 8/024 |
| DE | 2817549 | A1 * | 10/1979 | E01F 8/024 |
| DE | 2822294 | A1 * | 12/1979 | E01F 8/024 |
| DE | 3027924 | A1 * | 2/1981 | E01F 8/023 |
| DE | 3025692 | A1 * | 1/1982 | E01F 8/02 |
| DE | EP 0040807 | B1 * | 2/1984 | E01F 8/024 |
| DE | 3722412 | A1 * | 3/1989 | E01F 8/023 |
| DE | 3925401 | A1 * | 2/1991 | E01F 8/023 |
| DE | 4030270 | A1 * | 3/1992 | E01F 8/021 |
| DE | 4415766 | A1 * | 11/1995 | B09B 1/00 |
| DE | EP 0694653 | A2 * | 1/1996 | E01F 8/023 |
| DE | 4443478 | A1 * | 6/1996 | E01F 8/023 |
| DE | 19953939 | A1 * | 6/2001 | E01F 8/023 |
| DE | 10047894 | A1 * | 4/2002 | E01F 8/022 |
| EP | 0034565 | A1 * | 8/1981 | E01F 8/024 |
| FR | 2435661 | A1 * | 4/1980 | E01F 8/024 |
| FR | 2574440 | A1 * | 6/1986 | E01F 8/024 |
| FR | 2575201 | A1 * | 6/1986 | E01F 8/024 |
| FR | 2622915 | A1 * | 5/1989 | E01F 8/0023 |
| FR | 2637626 | A1 * | 4/1990 | E01F 8/023 |
| FR | 2864560 | A1 * | 7/2005 | E01F 8/024 |
| IT | EP 2426263 | A1 * | 3/2012 | E01F 8/023 |
| WO | WO-2007/085940 | A2 | 8/2007 | |

* cited by examiner

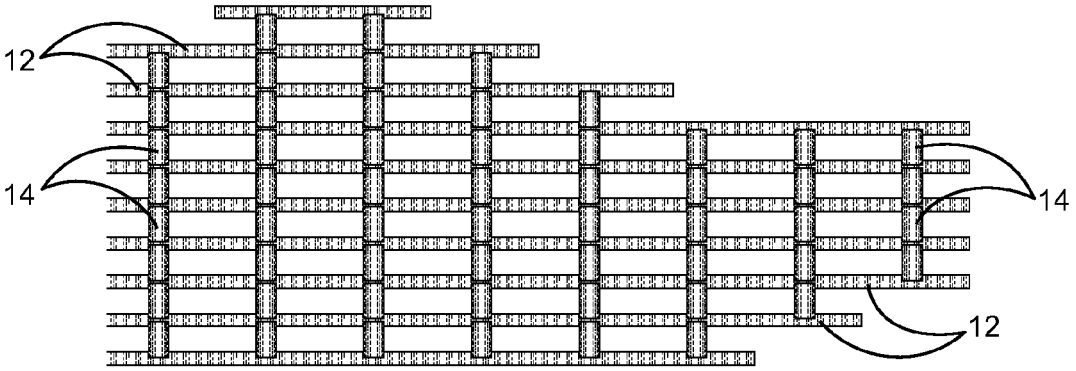
FIG. 1
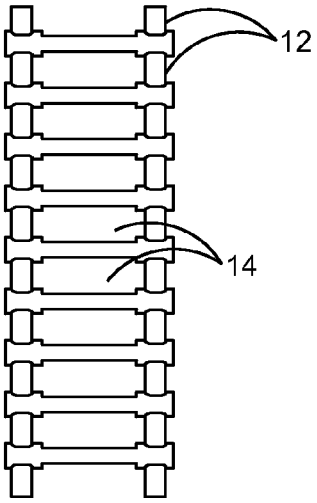
FIG. 2
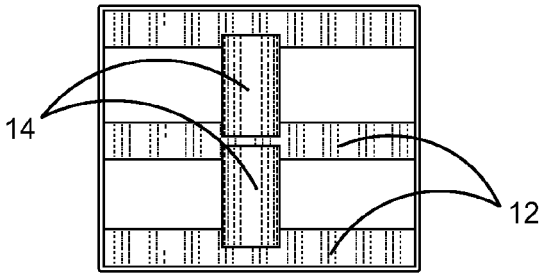
FIG. 3
REBAR SCHEDULE
| | |
|---|---|
| FOR WALLS 0-14' | USE #3 REBAR |
| FOR WALLS OVER 14' | USE #4 REBAR |
FIG. 4

SOUND ATTENUATING STRUCTURE

TECHNICAL FIELD

This invention relates generally to a sound attenuating structure and more particularly to a vertically oriented rectilinear self supporting structure having live vegetation growing from the side surfaces thereof. The sound attenuating structure of this invention is constructed of light weight horizontally disposed stretchers with perpendicular headers preferably formed using lightweight concrete composition which includes a relatively low cement content.

The assembled structure is filled with soil or other plant sustaining mixture which exposed surfaces thereof are planted with vegetation. Sheet or tile structures may be used at the exposed soil surfaces to propagate vegetation. Electrical or solar powered irrigation grid may be provided to facilitate vegetation growth.

BACKGROUND OF THE INVENTION

In many locations, particularly along highways and in certain industrial locations excessive noise occurs which interrupts other uses of the adjacent areas. In prior art structures to address this problem the noise is either reflected by wall surfaces or absorbed by such walls. However the prior art structures are not aesthetically pleasing and frequently have excessive weight and are otherwise difficult to maintain. Structures used in retaining wall installations have been used with some success in attenuating excess noise but such structures inherently failed to absorb adequate amounts of the noise generated due to the angled orientation of the retaining walls and are not free standing adapted to be assembled in open areas such as highway medians and the like. In addition the retaining wall installations require the presence of an earthen embankment against which the retaining wall is placed usually at a substantial angle from the vertical. This structure is not freestanding and cannot fully function as a freestanding noise attenuation barrier. Four or more separate structural elements are typically required for the installation of such retaining wall structures. The retaining wall structures of the prior art have only one exposed face so that it is not suitable for use in a median on a divided highway where both sides are required to have provision for the growth of sound attenuating vegetation.

SUMMARY OF THE INVENTION

Therefore, it is an object of the current invention to disclose a vegetated sound attenuating structure which is freestanding, in which due to its substantially vertical side surfaces with vegetation growing therefrom successfully attenuates the noise while providing an aesthetically pleasing appearance.

A further object of the current invention is to provide a vegetated sound attenuating structure having two sound attenuating surfaces extending along each side surface of the structure.

Another object of the invention is to provide a vegetated sound attenuating structure which is of simplified construction yet provides open latticework in which sound attenuating vegetation may be planted and maintained.

A further object of the invention is to provide a lightweight sound attenuating structure of simple construction preferably having an irrigation grid system which may be operated by solar power sources incorporated in, adjacent to or attached to the sound attenuating, structures.

The current invention satisfies those objects and others that will become apparent in the disclosure below, by providing a method for assembling a free standing sound attenuating structure using two specially designed structural elements, the first being a plurality of horizontally disposed elongated members, known as stretchers, extending end to end in two parallel rows. The second structural elements is a header which is positioned perpendicular to the stretchers and provided with key elements to retain the stretchers in a parallel array. Multiple courses of the stretchers and headers are built upon the course below to the height desired for the specific application. The elongated members or stretchers are each positioned vertically above the elongated member in the course below, positioned and separated therefrom by headers so that a substantially vertically disposed face of the elongated members is presented on both sides of the structure. The structures may incorporate a plurality of seed tiles positioned against the soil placed within the structure. Alternately, a mat containing seeds may be installed in the structure prior to inserting the soil, which mats aid in the placement and retention of the soil and provides seeds for vegetation. A free standing structure results which may then be irrigated to grow appropriate sound attenuating vegetation along one or both of the vertical surfaces of the array. A water distribution system may then be provided for irrigation of the vegetation as required. Preferably the water distribution system is electronically powered by solar panels placed upon the upper surface of the structure, or in adjacent areas.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings, wherein:

FIG. 1 is a side view of an assembled sound structure built according to the teachings of this invention.

FIG. 2 is an end view of the device shown in FIG. 1.

FIG. 3 is a partial view of the side surface of this invention showing the exposed facial texture of the stretchers forming the side surface thereof.

FIG. 4 is a tabulation showing rebar required for various forms of this invention.

DETAILED DESCRIPTION OF THE INVENTION

Figure 10:
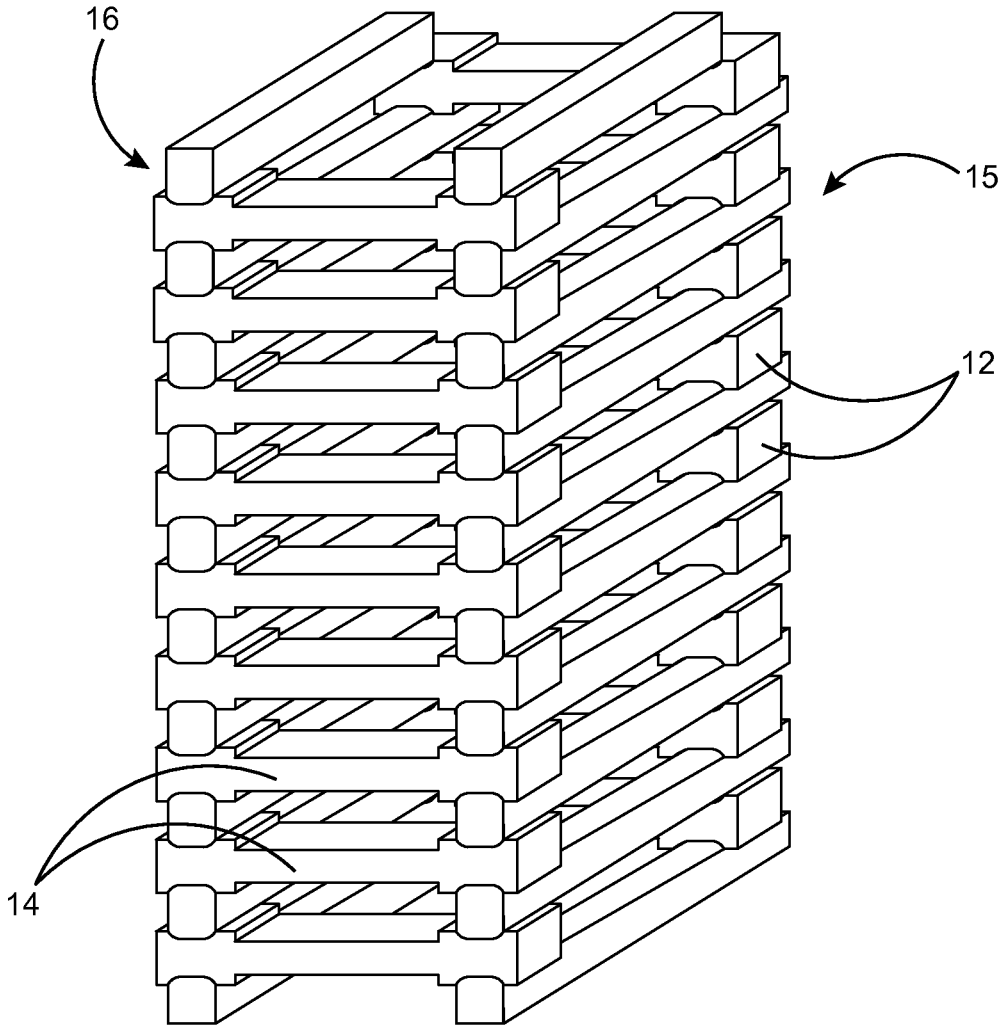
FIG. 10 is a perspective view of the assembled sound structure of this invention.

Turning now to the drawings, the invention will be described in preferred embodiments by reference to the numerals of the drawing figures, wherein like numbers indicate like parts. The assembled free standing structure is best seen in FIG. 10, showing the stretchers 12 and headers 14 arrayed in their perpendicular orientation and multiple courses thereof extending upwardly to the desired height. Typically the assembly will have a vertical height of up to 14 feet. Both elongated vertical surfaces 15 and 16 which are formed from stretchers 12 and headers 14 have open areas extending inwardly providing access to earth or a mixture of earth and rubble placed within the area defined by the stretchers and headers, so that plants may be grown in the open areas of the vertical wall. The stretchers 12 which extend along each wall surface are held in place by the headers 14 which have at each end thereof retainers 19 formed along the top and bottom sides of headers 14 which are adapted to engage stretchers 12 and prevent stretchers 12 from moving outwardly from the assembled array. Stretchers 12 are elongated in nature for example five to ten feet in length and may be staggered as shown in FIG. 1 in alternating joints or in the joints may be positioned at the retainers 19.

Figure 5:
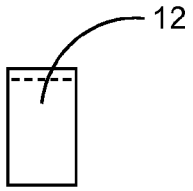
FIG. 5 is an end view of the stretcher used in the assembly of this invention.
Figure 7:
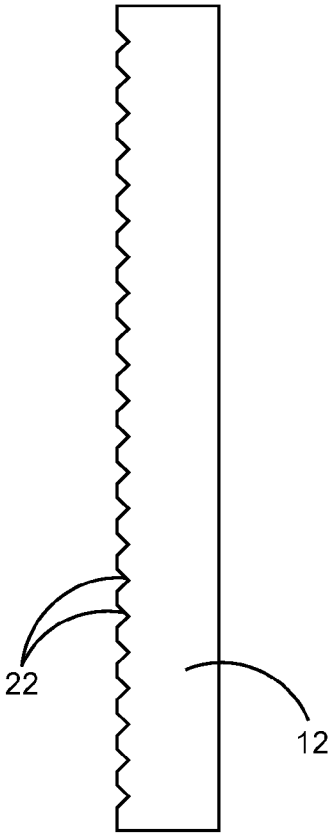
FIG. 7 is a plan view of the stretcher shown in FIGS. 5 and 6.
Figure 6:
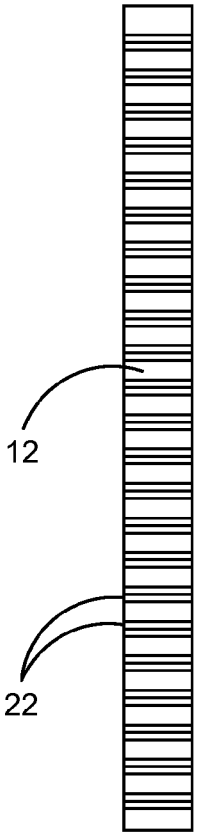
FIG. 6 is a side surface view of the stretcher used in the assembly of this invention.

In FIGS. 5, 6 and 7 the stretcher 12 is shown in detail. In the design shown, shaped notches 22 are formed in the face of stretcher 12 to provide an aesthetically pleasing appearance. Normal dimensions are provided as an example in which stretcher 12 has a length of 5 feet of height of 4 inches and a depth of 5½ inches with the notches 22 having a depth of ½ inch. These dimensions are provided, for explanation purposes only and may be varied to suit the user and the appearance and applications for the array.

Figure 8:
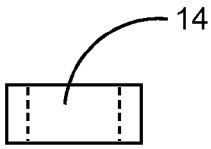
FIG. 8 is an end view of the header used in the assembly of this invention.
Figure 9:
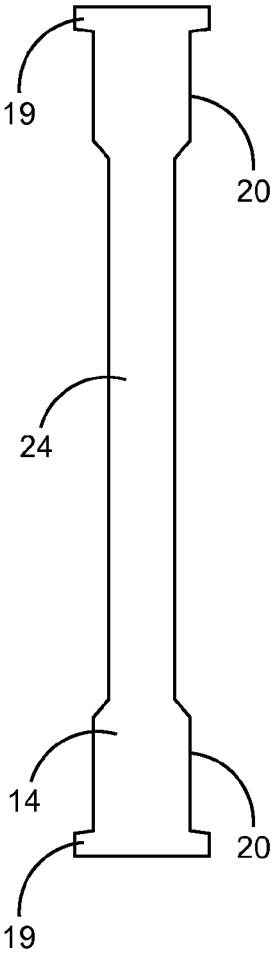
FIG. 9 is a side view of the header of this invention.

In FIGS. 8 and 9 the header 14 used in one example of this invention is shown together with typical dimensions. For example the header 14 has indexing keys 19 positioned at the end thereof to engage and prevent outward movement of stretcher 12. Stretcher engaging services 20 are shown separated by height of 8 inches and the internal portion 24 extending from each end thereof has height dimension of 5 inches. The overall length of header 14 is shown as 4' 6" These dimensions are provided for explanation purposes only and may be varied to suit the user and the application for the array.

When the array of stretchers and headers is assembled as shown in FIG. 10 the interior thereof is filled with an earthen mixture or soil suitable for growing appropriate aesthetically pleasing and sound absorbing plants. Prior to inserting the soil, panels of sheeting such as fabric, screen or the like may be inserted inside the assembly to control and place the soil. Once the soil is inserted and compressed to the desired degree, the plants are placed there in either directly or if sheeting panels are used through apertures cut therein. The assembly may be provided with irrigation facilities or in some installations natural rainwater and the like may be found adequate to supply moisture and maintain the plant growth.

Figure 11:
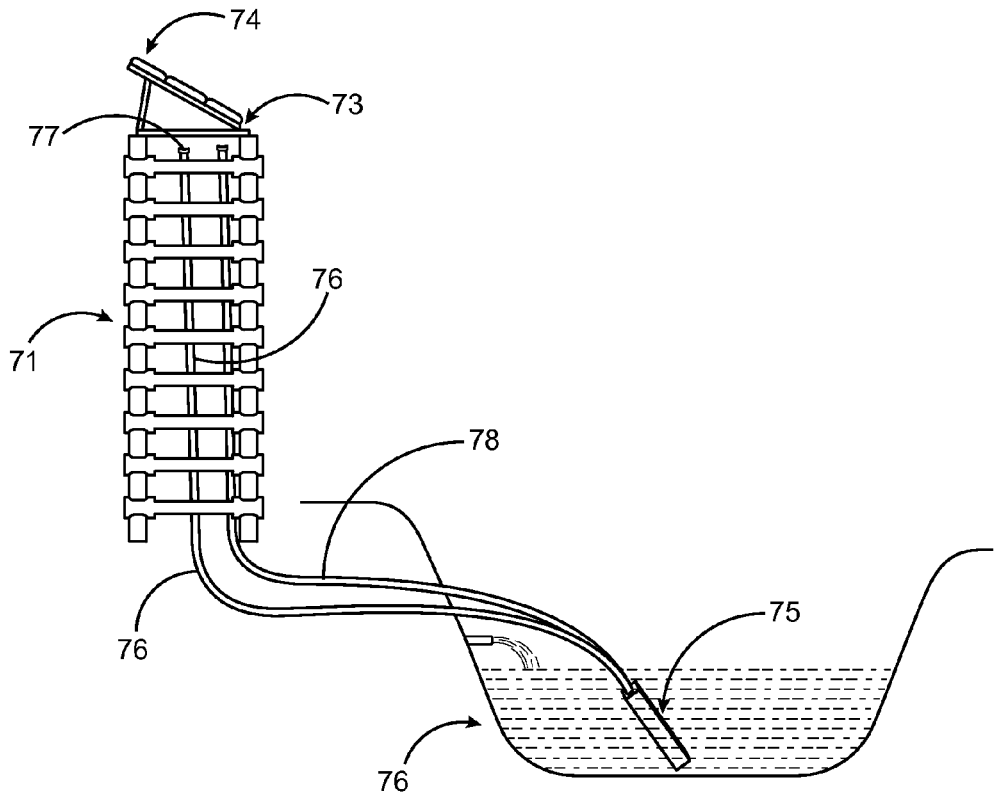
FIG. 11 is an end elevation of 1 embodiment of this invention having a solar powered irrigation grid system installed therein.

FIG. 11 shows a pictorial view of the sound attenuation structure of this invention showing one form of the irrigation system contemplated, including a solar panel 74 mounted at the top of the sound attenuating structure 71. Electricity generated by solar panel 74 is transmitted to a pump 75 by conduit 78. The pump 75, which is preferably a solar powered submersible helical pump with water level electrode to prevent pump run dry damage, is connected to a water distribution system by a distribution height 76 which opens at the upper end at distribution opening 77. Advantageously, rainwater may be collected in storage reservoir 72 or water may be supplied to reservoir 72 from various sources in areas in which rainwater is inadequate to maintain a level of water in the reservoir 72.

Figure 12:
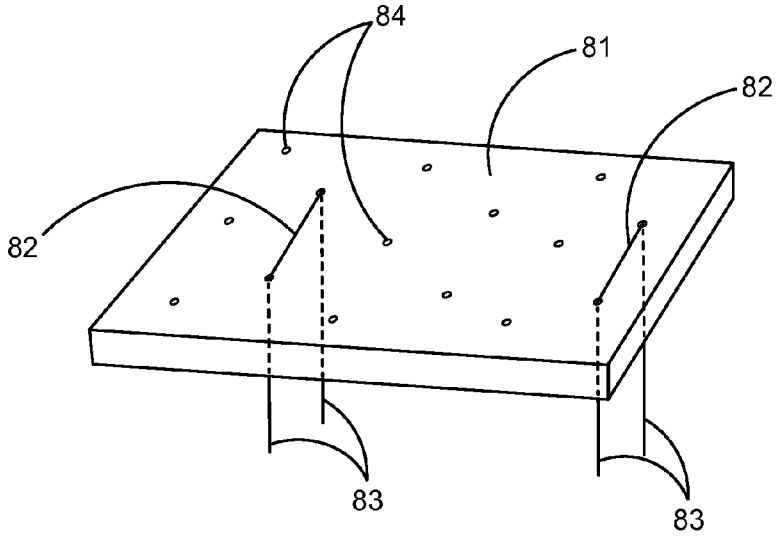
FIG. 12 is a perspective view of a seed bearing panel adapted to be placed in the open areas of the vegetated sound structure of this invention in contact with the soil deposited inside the structure.

In FIG. 12 a tile 83 is shown containing fertile seeds of the plants desired to be grown in the vegetated sound attenuation structure of this invention. Tile 83 which contains seeds and may contain nutrients is sized to be positioned in the open areas of the sound attenuating structure. Preferably the panel 83 is constructed of a coconut fiber backed vegetated plant tile configured to fit into the open areas of the side of the vegetated sound structure of this invention. Wire staples 82 project through the panel 83 and into the soil contained within the structure to anchor panel or tile 83 in place. When irrigation of the soil within the structure is commenced, the seeds germinate and are rooted into the soil.

Alternatively, a mat constructed of fibers such as coconut fiber with seeds and nutrients contained therein may be draped across the interior of the vegetated sound structure prior to insertion of soil. The mat retains the soil in place within the vegetated sound structure and when irrigation begins, provides seeds for the plants desired for the structure.

The resulting freestanding structure of this invention exhibits superior noise attenuation properties as compared to conventional noise barriers. Enhanced growth of vegetation on the surface of the sound attenuating structure further enhances noise attenuation. The nice attenuating structure of this invention provides a pleasing appearance. The vegetation absorbs a significant amount of particulate and gaseous pollution further enhancing the area in which the vegetated sound structures are utilized

INDUSTRIAL APPLICABILITY

The invention has applicability in the field of sound attenuation and pollution control and more particularly in the application of barriers to provide sound absorption and prevent unwanted sound transmitted from such sources as highways and industrial facilities.

What is claimed is:

1. A method of providing a vegetated sound attenuation barrier for areas adjacent highways, industrial facilities and the like, comprising the steps of:

leveling a ground area;

laying a first course of concrete stretchers comprising first and second parallel rows thereof defining a length of the sound attenuation barrier;

installing headers at intervals along said first course, perpendicular to said concrete stretchers, said headers each being of equal length to position said stretchers in a vertical plane for each of first and second sound attenuation faces of said sound attenuation barrier;

repeating the steps of installing the course of concrete stretchers so that said first and second rows thereof are positioned and separated by said headers and placing the headers perpendicular to said first and second rows to form a vertical array until a height for each of said first and second sound attenuation faces of the vegetated sound attenuation barrier is achieved;

configuring a plurality of said headers each with a respective internal portion, a first stretcher engagement portion between a first end of said internal portion and a first indexing key, and a second stretcher engagement portion between a second end of said internal portion and a second indexing key, wherein said first and second indexing keys are positioned at respective ends of said header to engage and prevent outward movement of a respective one or more of said stretchers, wherein each of said first and second stretcher engagement portions have a first height that separates respective upper and lower weight-bearing stretcher engagement surfaces, wherein each of said first and second indexing keys has a height greater than said first height, and wherein each of said internal portions has a height less than said first height;

placing soil inside said sound attenuation barrier; and, planting appropriate plants in the exposed soil positioned between the courses of the concrete stretchers and between successive ones of the headers at each end of said sound attenuation barrier.

2. The method of claim 1 wherein said stretchers and said headers are formed from concrete.

3. The method of claim 1 further including the step of installing irrigation means to maintain the moisture level in said soil.

4. The method of claim 1 wherein said stretchers have slots formed vertically therein so as to facilitate engagement with said plants.

5. The method of claim one further including installing seed bearing tiles against an exposed surface of said soil.

6. The method of claim one wherein seed bearing fabric panels are inserted into the interior of said array before installation of said soil.

7. The method of claim 3 wherein solar panels are installed at the top of said array to provide power for said irrigation means.

8. A vegetated noise barrier for placement on a horizontal surface and extending substantially vertically upwardly therefrom with both sides thereof exposed for growth of plants to aid in sound attenuation and provide a pleasing aesthetic surface comprising:

a plurality of stretchers extending end to end in two parallel rows;

a plurality of headers extending perpendicular to said stretchers and defining the distance between said two parallel rows of stretchers;

a second plurality of stretchers positioned vertically above said first plurality of stretchers;

a second plurality of headers positioned vertically above said first plurality of headers to define rectilinear structure; and, further pluralities of headers and stretchers positioned vertically above to define the vertically disposed rectilinear structure of the desired height including headers that each have a respective internal portion, a first stretcher engagement portion between a first end of said internal portion and a first indexing key, and a second stretcher engagement portion between a second end of said internal portion and a second indexing key, wherein said first and second indexing keys are positioned at respective ends of said header to engage and prevent outward movement of a respective one or more of said stretchers, wherein each of said first and second stretcher engagement portions have a first height that separates respective upper and lower weight-bearing stretcher engagement surfaces, wherein each of said first and second indexing keys has a height greater than said first height, and wherein each of said internal portions has a height less than said first height, all of said headers being of equal length;

soil to fill the void formed by said pluralities of stretchers and headers with exposed portions there of extending between said pluralities of stretchers and headers;

wherein a sound attenuating structure having soil accessible through vertical sides and ends thereof is formed and wherein said height of each of said internal portions being less than said first height results in a vertically expanded plantable gap between successive ones of said headers at each end of said sound attenuation barrier.

9. The sound attenuating structure of claim 8 further including seed containing mats inserted into the interior of said structure prior to installation of said soil.

10. The sound attenuating structure of claim 8 further including seed containing mats inserted into the interior of said structure prior to installation of said soil.

11. The sound attenuating structure of claim 8 further including irrigation means to distribute water into the soil at the top of said sound attenuating structure.

12. The sound attenuating structure of claim 8 further including a solar panel array to provide electricity for irrigation of said sound attenuating structure.

13. The sound attenuating structure of claim 8, wherein said first height that separates respective upper and lower weight-bearing stretcher engagement surfaces of each of said first and second stretcher engagement portions of each of said headers is 8 inches.

14. The sound attenuating structure of claim 8, wherein said first height that separates respective upper and lower weight-bearing stretcher engagement surfaces of each of said first and second stretcher engagement portions of each of said headers is 8 inches and wherein said height of said internal portions of said headers is 5 inches.

* * * * *